United States Patent [19]

Piascinski

[11] 3,932,011

[45] Jan. 13, 1976

[54] CONDITIONING PARTIALLY-COMPLETED CRT BULB ASSEMBLY FOR STORAGE AND/OR TRANSIT

[75] Inventor: Joseph John Piascinski, Leola, Pa.

[73] Assignee: RCA Corporation, New York, N.Y.

[22] Filed: June 5, 1974

[21] Appl. No.: 476,441

[52] U.S. Cl. ..... 316/17; 316/21

[51] Int. Cl.[2] ..... H01J 9/00; H01J 9/38

[58] Field of Search ..... 316/17, 18, 19, 20, 21, 316/24, 25, 30; 29/25.11, 25.13; 117/33.5 C, 33.5 CP

[56] References Cited

UNITED STATES PATENTS

| | | | |
|---|---|---|---|
| 3,063,777 | 11/1962 | Trax | 316/2 |
| 3,317,319 | 5/1967 | Mayaud | 117/33.5 C |
| 3,658,401 | 4/1972 | Files | 316/21 |
| 3,703,401 | 11/1972 | Deal et al. | 117/33.5 CP |

*Primary Examiner*—Roy Lake
*Assistant Examiner*—James W. Davie
*Attorney, Agent, or Firm*—G. H. Bruestle; L. Greenspan

[57] ABSTRACT

In the method of making a cathode-ray tube comprising a luminescent-viewing-screen structure including an aluminum metal layer in contact with a layer of carbon particles, the steps soon after the faceplate panel is heat sealed to the funnel, of flushing the still-hot assembly with a dry noncontaminating gas, such as nitrogen or air, then cooling the assembly to room temperature and then reflushing the assembly with a dry noncontaminating gas, and then capping the assembly with a temporary closure. The assembly so conditioned can be held or stored for a relatively long term between the heat sealing step and the subsequent manufacturing steps without degradation of the conductivity or reflectivity of the aluminum metal layer.

7 Claims, 1 Drawing Figure

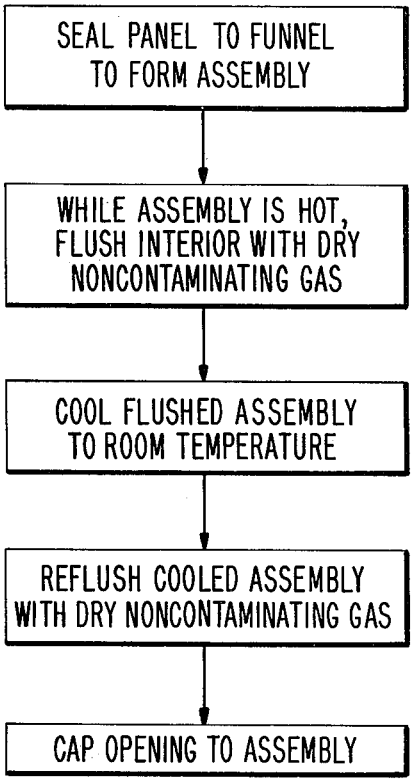
SEAL PANEL TO FUNNEL TO FORM ASSEMBLY
WHILE ASSEMBLY IS HOT, FLUSH INTERIOR WITH DRY NONCONTAMINATING GAS
COOL FLUSHED ASSEMBLY TO ROOM TEMPERATURE
REFLUSH COOLED ASSEMBLY WITH DRY NONCONTAMINATING GAS
CAP OPENING TO ASSEMBLY

CONDITIONING PARTIALLY-COMPLETED CRT BULB ASSEMBLY FOR STORAGE AND/OR TRANSIT

BACKGROUND OF THE INVENTION

This invention relates to a novel method for conditioning partially-completed cathode-ray-tube bulb assemblies for long-term storage and/or for transit to their final assembly plant.

A shadow-mask color-television picture tube is prepared by steps including (a) producing a luminescent-screen structure upon the inner surface of a faceplate panel, (b) heat-sealing the panel to the large opening of a funnel, (c) heat-sealing a mount assembly to the small opening of said funnel, and then (d) exhausting and sealing the tube. In some situations, it is desired to store for a relatively long term; e.g., three to thirty days, the partially-completed assembly as it exists after step (b). In other situations, it is desired to ship such partially-completed assemblies to distant manufacturing plants; e.g., a hundred to three thousand miles away, which may require relatively long transit time. In both situations, the assembly may be and usually is subjected to fluctuations in temperature and humidity.

Some tubes have screen structures comprising a layer of aluminum metal in contact with a layer of carbon particles, which may be either crystalline, such as graphite, or may be amorphous, such as lamp black. The carbon layer may be employed on the viewing side of the screen structure as a lightabsorbing matrix as described, for example, in U.S. Pat. No. 3,558,310 to E. E. Mayaud, and/or on the gun side of the screen structure as a heat-absorbing layer as described, for example, in U.S. Pat. No. 3,703,401 to S. B. Deal et al. In either or both type structures, the aluminum metal layer is progressively degraded in conductivity and reflectance by conversion to aluminum compounds when the layer is exposed for any extended term to normal ambient water-vapor concentrations in excess of about 2500 ppm (parts water vapor per million parts gas), which corresponds to the dew point of about +12°F. The degradation starts at random points on the aluminum layer and spreads outwardly therefrom. Even when only small areas of the aluminum layer are degraded in this manner, the tube is rendered unsalable.

In solving a different problem, U.S. Pat. No. 3,650,401 to J. A. Files suggest flushing the bulb assembly with a dry (dew point −22°F or −30°C) noncontaminating gas soon after heat sealing the panel to the funnel, and then capping the bulb assembly with a temporary closure. Such prior process has been found to retard the degradation of the aluminum metal layer where there is no carbon layer present. But, where a carbon layer contacts the aluminum metal layer, this treatment is effective for only a short period of time.

SUMMARY OF THE INVENTION

The novel method follows the procedural steps outlined above except that, just after heat-sealing the panel to the funnel, the following procedure is carried out: (a) while the tube is still hot (e.g., 150° to 300°F) from heat sealing the panel to the funnel, the interior of the assembly is flushed with a dry noncontaminating gas, (b) the flushed bulb assembly is cooled to room temperature, (c) then the cooled bulb assembly is reflushed with a dry noncontaminating gas and (d) the reflushed assembly is capped with a temporary closure. A dry gas is defined herein as containing less than about 100o parts water vapor per million parts gas. This corresponds to a dew point of about −20°C and less.

By following the novel method of flushing the hot assembly, cooling the flushed assembly to room temperature, reflushing the cooled assembly, and then capping the reflushed assembly, degradation of the aluminum metal layer in contact with a layer of carbon particles has been substantially entirely prevented over relatively long periods of time, for example, up to thirty-nine days. Experience has shown that the capped, reflushed assembly, can be exposed over a long term to ambients where the temperature fluctuates down to 0°F and the humidity fluctuates up to a dew point of about 70°F (about 100,000 ppm water vapor) without degrading the aluminum layer.

BRIEF DESCRIPTION OF THE DRAWING

The sole FIGURE is a flow diagram of the invention.

DESCRIPTION OF THE PREFERRED EMBODIMENTS

The steps of the novel method are generally those that are used for making a shadow-mask cathode-ray tube. In that method, a glass faceplate panel is heat sealed to a glass funnel with a devitrifiable glass frit by the method described for example in U.S. Pat. No. Re. 25,791 to S. A. Claypoole to form the bulb assembly. Prior to heat sealing the panel to the funnel, a mask assembly is mounted in the faceplate panel. A luminescent-screen structure comprising a carbon particle layer and an aluminum metal layer has been produced on the inner surface of the panel. Also, the funnel is provided with an internal conducting coating, which may be of graphite. The funnel is comprised of a cone portion sealed at its larger end to the faceplate panel and a cylindrical neck portion joined to a smaller end of the cone and having its other end open to receive the stem of the mount assembly.

In accordance with the novel method, shortly after the bulb assembly leaves the heat-sealing lehr, and while it is still hot (about 200°C) from the lehr, the interior of the assembly is flushed with a dry noncontaminating gas. This may be done by the method shown in FIGS. 2 to 4 of U.S. Pat. No. 3,658,401 to J. A. Files, by inserting an elongated tube and a surrounding resilient stopper into the open end of the neck portion of the bulb assembly and admitting the dry gas from a gas source through a valve and associated tubing. The upper end of the tubing may be formed with apertures for directing the gas in a desired manner; for example, outwardly. The outer periphery of the stopper is either noncircular or is formed with longitudinal grooves to permit the residual gases within the bulb assembly to be flushed out by the gas that is introduced. Instead of centering the tubing axially with respect to the stopper, the tubing may be eccentric to the stopper to improve the flushing action. The size of the tubing, the size of the apertures and the grooves and the gas pressure used to introduce the gas are chosen to provide the desired flushing action within the desired flushing time. In one apparatus that has been used successfully in making twenty-five-inch rectangular color picture tubes, the envelope is flushed for about 1 minute and the volume within the bulb assembly is exchanged at least three times.

The dry noncontaminating gas used for flushing is preferably dry warm air containing about 350 ppm water vapor (which has a dew point of about −22°F or −30°C). The flushing gas should be nonreactive to the tube structure. Air, oxygen, nitrogen, argon, helium, neon, and mixtures thereof may be used. The water-vapor content of the gas should be less than 1,000 ppm or have a dew point of less than about −4°F. Hydrocarbon gases, carbon dioxide, and other contaminants, if any, should be removed from the flushing gas. The temperature of the flushing gas is not critical and may be at, above, or below room temperature.

After the flushing is completed, the flushing apparatus is removed. The sealed flushed bulb assembly is permitted to cool to room temperature. This is about 60° to 75°F. Then, the interior of the assembly is again flushed in the same manner as described above with a dry noncontaminating gas, preferably warm air having a dew point of about −22°F. Then, a resilient cap, such as that shown in FIG. 5 of the above-cited Files patent is applied to cover the neck opening to maintain the bulb assembly filled with the noncontaminating gas at atmospheric pressure for a relatively long term prior to the next manufacturing operation, which is usually the combined gun insertion and mount-sealing step. It has been found that envelopes so flushed and capped can be held or stored up to six weeks, if necessary or desired, without degradation of the aluminum metal layer of the screen structure.

After storage and/or transit, the cap is removed and the mount assembly is inserted in the neck of the bulb assembly, and the glass stem of the mount assembly sealed into the neck by known methods; for example, as shown in FIG. 5 of U.S. Pat. No. 3,063,777 to A. L. Trax. The bulb assembly with the mount assembly sealed therein may now be exhausted and baked to remove gases therein and to degass various of the structures and internal surfaces, by any known method; for example, as described in U.S. Pat. No. 2,532,315 to A. L. Johnson et al. After exhausting and baking the bulb assembly, the tube is completed by performing the conventional steps of activating the cathode, tipping off the exhaust tubulation, flashing the getter, aging the gun electrodes, and testing the tube.

In one test series, six 19-inch faceplate panels were provided with a screen structure comprising a luminescent layer, a light-absorbing matrix, and an aluminum-metal reflecting layer. The panels were baked to remove volatile material, cooled to room temperature and then stored in a plastic bag with desiccant until they were ready for heat sealing. The faceplate panels were sealed as described above, and after sealing, the gases in the sealed bulb assemblies were examined for moisture content before subsequent processing according to the novel method. As a group, the moisture content of the sealed bulb assemblies averaged about 6050 ppm water vapor. The frit sealed bulbs were divided into the following groups:

| | | |
|---|---|---|
| Group I | double-flushed and | not capped |
| Group II | double-flushed and | capped |
| Group III | not flushed and | not capped |
| Group IV | not flushed and | capped |
| Group V | single-flushed and | capped |
| Group VI | single-flushed and | not capped |

After the above processing, all six groups were placed in an environmental chamber and cycled from room temperature to 0°F, held for two hours and quickly returned to room temperature and humidity. The ambient contained about 3900 ppm water vapor (dew point of about +22°F). The bulbs were examined for defects to the aluminum-metal layer and to the screen. Only Group II, double-flushed and capped, did not have moisture defects. The following Table contains a summary of the moisture levels during the test using a du Pont 510 moisture analyzer.

TABLE

| | Before Flush | Dew Point | After 1st Flush | Dew Point | After 2nd Flush | After Cycle | Dew Point |
|---|---|---|---|---|---|---|---|
| Group I | 6000 | +32°F | 500 | −16°F | 300 | 3000 | +15°F |
| Group II | 5500 | +30°F | 300 | −25°F | 100 | 800 | − 7°F |
| Group III | 6000 | +32°F | — | — | — | 4000 | +23°F |
| Group IV | 6000 | +32°F | — | — | — | 4000 | +23°F |
| Group V | 6200 | +32.5°F | 350 | −23°F | — | 2800 | +14°F |
| Group VI | 6000 | +32.5°F | 400 | −20°F | — | 2500 | +12°F |

I claim:

1. In the method of making a cathode-ray tube including the steps of i. producing a luminescent viewing-screen structure comprising an aluminum metal layer in contact with a layer of carbon particles, said structure being supported on the inner surface of a faceplate panel, ii. heat sealing said panel to the large opening of a funnel, iii. and then heat sealing a mount assembly to the small opening of said funnel, the steps just subsequent to step (ii) and prior to step (iii) comprising:

a. while said panel and funnel assembly is still hot from heat sealing, flushing the interior of said assembly with a dry, noncontaminating gas, b. cooling said flushed assembly to room temperature, c. reflushing said cooled assembly with a dry noncontaminating gas, d. and then capping the small opening of said funnel with a temporary closure.

2. The method defined in claim 1 wherein said noncontaminating gas contains less than 1000 parts water vapor per million parts gas.

3. The method defined in claim 2 wherein said noncontaminating gas is air.

4. The method defined in claim 1 wherein the time elapsed between step (d) and step (iii) is at least three days.

5. The method defined in claim 1 wherein the carbon-particle layer is a heat-absorbent layer comprised of a mixture of graphite and amorphous carbon on the gun side of said screen structure.

6. The method defined in claim 1 wherein the carbon-particle layer is a light-absorbent layer comprised of graphite on the viewing side of said screen structure.

7. The method defined in claim 1 wherein said carbon-particle layer is comprised of at least one member of the group consisting of amorphous carbon and graphite.

* * * * *